US006807791B2

(12) United States Patent
Herb

(10) Patent No.: US 6,807,791 B2
(45) Date of Patent: Oct. 26, 2004

(54) DOUBLE-RAIL PROFILE

(75) Inventor: Armin Herb, Apfeldorf (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/138,343

(22) Filed: May 3, 2002

(65) Prior Publication Data

US 2002/0170263 A1 Nov. 21, 2002

(30) Foreign Application Priority Data

May 17, 2001 (DE) ..... 101 23 906

(51) Int. Cl.[7] ..... E04C 3/30

(52) U.S. Cl. ..... 52/732.1; 52/734.1; 52/780; 52/781; 52/775; 248/317; 248/58; 248/62

(58) Field of Search ..... 248/317, 58, 63, 248/62; 52/732.1, 734.1, 731.6, 733.2, 735.1, 781, 780, 775

(56) References Cited

U.S. PATENT DOCUMENTS 3,043,408 A 7/1962 Attwood
3,668,827 A * 6/1972 Schwartz ..... 52/732.1
4,564,165 A * 1/1986 Grant et al. ..... 248/317
5,314,156 A 5/1994 Moses
5,326,204 A * 7/1994 Carlson et al. ..... 52/732.1
5,351,926 A * 10/1994 Moses ..... 52/731.1
D363,997 S * 11/1995 Nomura ..... 52/732.1
6,283,456 B1 * 9/2001 Benz et al. ..... 52/732.1

FOREIGN PATENT DOCUMENTS

EP 0596207 5/1994

* cited by examiner

*Primary Examiner*—Carl D. Friedman
*Assistant Examiner*—Nahid Amiri
(74) *Attorney, Agent, or Firm*—Sidley Austin Brown & Wood, LLP

(57) ABSTRACT

A rail profile is provided with two connection zones (1) situated opposite to each other and having an essentially C-shaped cross-section and a rear wall (4) with an essentially V-shaped cross-section. The structural height (a) of the rail profile is minimal because of the rear wall (4) design and consequently the handling of the rail profile is enhanced.

7 Claims, 3 Drawing Sheets

DOUBLE-RAIL PROFILE

BACKGROUND OF THE INVENTION

Figure 1:
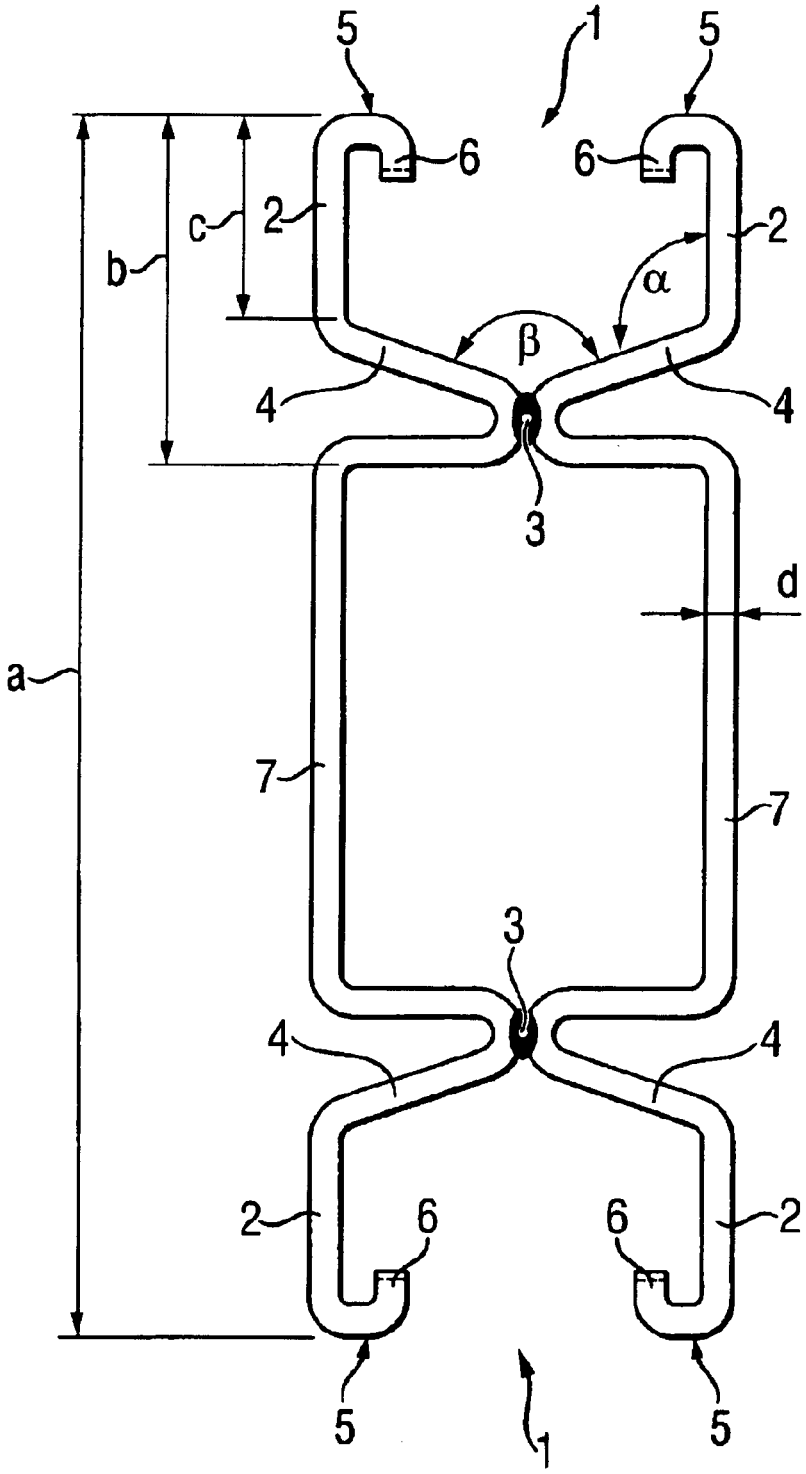
Figure 2:
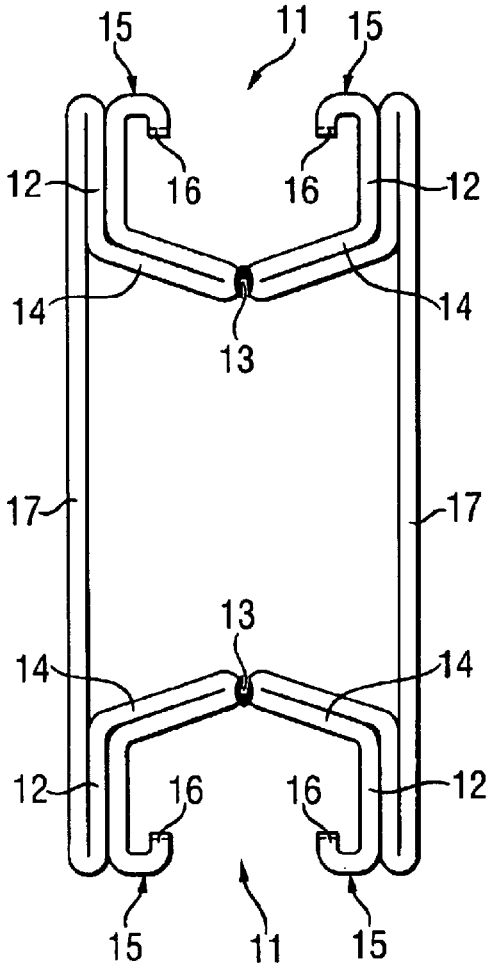
Figure 3:
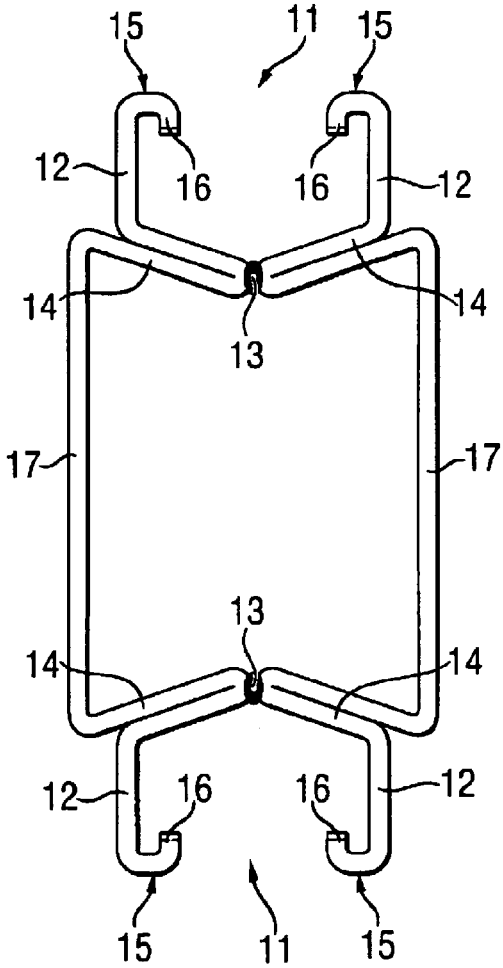

The invention relates to a rail section or profile having two connection zones that are opposite each other and that exhibit an essentially C-shaped cross-section. The connection zones including two side walls each run almost parallel to each other, project from a rear wall and exhibit open end zones. The connection zones each have angular deflections with webs running almost parallel to the side walls, wherein the two rear walls are connected to each other by connector walls running essentially parallel to the side walls.

The rail profile described above is used for the mounting, in particular, for the suspension, of tube or pipe mountings. In such instances, a tube or a pipe is suspended on a rail profile from a pipe clamp or pipe collar. Further, for example, a structure may be constructed by the connection of a plurality of rail profiles. It is easily possible to detachably fasten a fastener, for example, a rail nut-type fastener, to any point of a rail profile, to which an object can be fastened, due to the essentially C-shaped cross-section of the rail profiles.

DE 298 23 181 discloses a rail profile comprising two connection zones that are opposite each other and exhibit an essentially C-shaped cross-section. Further, each of the two connection zones has a rear wall that are joined together by connection walls.

The advantage of this known rail profile is its high stability, in particular, its resistance to torsion stresses, and its economical manufacture.

The disadvantage of this known rail profile is that its structural height, which extends parallel to its side walls and perpendicular to its longitudinal axis, is inconvenient for many applications due to the arrangement of two connection zones. The handling of this rail profile is made more difficult for the user because of the excessive structural height of this rail profile compared to other known rail profiles with a connection zone.

The object of the present invention is to provide a rail profile with two connection zones that are essentially C-shaped in their cross-section, that exhibit a minimal structural height and that can be economically manufactured. Additionally, it is the object of this invention to provide a rail profile that is highly stabile.

SUMMARY OF THE INVENTION

The object is achieved, according to the invention, with a rail profile having a rear wall that has an essentially V-shaped cross-section with a base plane angle that faces towards the corresponding free ends and that is smaller than 180°.

The structural height of the side walls, which extend perpendicular to the longitudinal axis of the rail, are small dimensioned because the rear wall has a V-shaped cross-section and an inserted fastener element, especially in the middle section, has a significant structural height. Further, a high degree of stability is attained as a result of the essentially V-shaped cross-section of the rear wall, particularly, in the area of torsion rigidity. Naturally, the cross-section of the rail profile can, for example, be W-shaped or even U-shaped when a fastener element has a correspondingly shaped lower portion that extends into the corresponding rear wall.

The base plane angle is, preferably, about 120° to 160° to achieve the least possible structural height and to assure simple mounting of a fastener element.

Advantageously, the vertical line formed by the base plane angle, of the rear wall, runs essentially central to the side walls to optimally receive the fastener element being used.

The vertical line, preferably, runs parallel to the side wall to assure the easy sliding of a fastener element into the connection zone. If due to certain conditions, for example, it is undesirable to use such sliding, then the vertical line may be guided to deviate from the side wall. Further, as a result of precisely matching the dimensions of the fastener elements to be used and the formation of the vertical line, a dent effect can be achieved between the fastener element used and the connection zone.

Advantageously, the plane running through the respective vertical line forms a plane of symmetry for the rail profile. Thus, the use of both connection zones is facilitated for the user, since the rail profile is symmetrical, i.e., mirror-symmetrical.

Preferably, the rail profile is formed by two curved shaped parts that are joined to each other along the two vertical lines, thereby assuring the economical manufacture of the rail profile.

The two shaped parts are preferably bonded together such that a stabile connection of the two shaped parts is guaranteed.

The structural height of the rail profile extending from one free end to the corresponding free end is preferably 3.5 to 4.5 times the connection height extending from one free end to the corresponding rear wall. Such an arrangement guarantees an optimal balance between the stability of the rail profile and its structural height.

In a further preferred embodiment, the extension of the connection zone perpendicular to the opening corresponds to 1.25 to 1.75 times the extension of the side wall perpendicular to the opening, to assure optimal dimensioning of the rail profile.

Preferably, the two shaped parts include, for example, in particularly stressed areas, a multiple of the wall thickness of the other areas of the molded form. In a particularly preferred embodiment, such parts include one or a plurality of folds or bends.

Preferably, the two shaped parts include zones having essentially V- or U-shaped cross-sections to assure increased stability in those areas. In particular, the rear wall and/or the side walls include at least some zones having an essentially V- or U-shaped cross-section.

BRIEF DESCRIPTION OF THE INVENTION

The invention will be more completely explained in the description below read together with reference to several exemplary embodiments that are presented in the drawings, wherein FIG. 1 represents a cross-section of an exemplary embodiment of a rail profile in accordance with the present invention.

FIG. 2 to FIG. 5 represent further exemplary embodiments of a rail profile, in cross-section, in accordance with the present invention.

DETAILED DESCRIPTION OF THE DRAWINGS

FIG. 1 represents a rail profile, according to the invention, having two connection zones 1 situated opposite each other and having essentially C-shaped cross-sections, each having two side walls 2 running approximately parallel to each other. The side walls 2 project from a rear wall 4 and have free end zones 5, which are provided with a curvature with webs 6 running essentially parallel to the side walls 2. The two rear walls 4 are joined together by connection walls 7 running essentially parallel to the side walls 2.

The rear wall 4 each exhibit an essentially V-shaped cross-section whose base plane angle (β) facing the free end zones 5 is smaller than 180°, and, in particular, is 140°. Further, the vertical line 3, of the rear wall 4, formed by the base plane angle (β), runs essentially central and almost parallel to the side walls 2. The two vertical lines 3 define a plane of symmetry of the rail profile.

The rail profile is manufactured, for example, from two bent shaped parts that are materially bonded along the two vertical lines 3 by a welded seam.

The structural height a extending from one free end 5 to the corresponding free end 5 of the rail profile is approximately 4 times the connection height b extending from one free end 5 to the corresponding rear wall 4. In addition, the connection height b corresponds to approximately 1.5 times the extension c of the side wall perpendicular to the opening.

FIGS. 2 to 5 represent other exemplary embodiments of rail profiles according to the invention with two connection zones 11 situated opposite each other and having essentially a C-shaped cross-section, each with side walls 12 running almost parallel to each other. The side walls 12 project from a rear wall 14 and have free end zones 15, which have webs 16 running essentially parallel to the side walls 12. The two rear walls 14 are joined to each other by connection walls 17 each running essentially parallel to the side walls 12.

Figure 4:
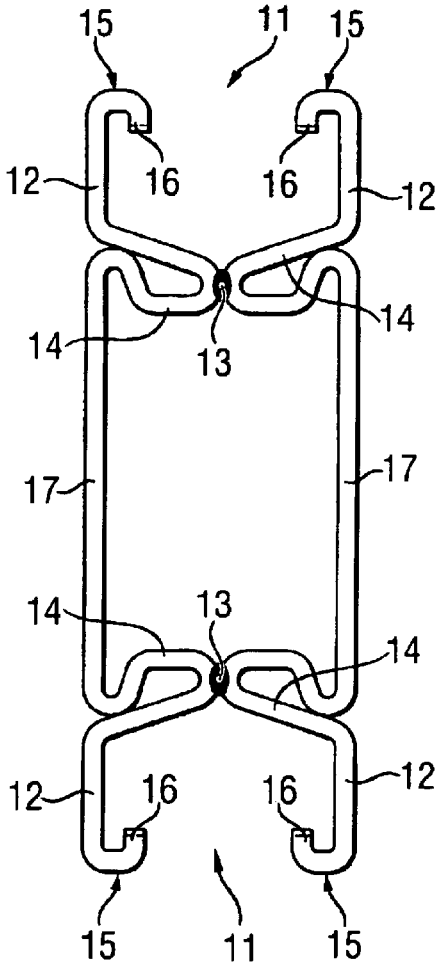
Figure 5:
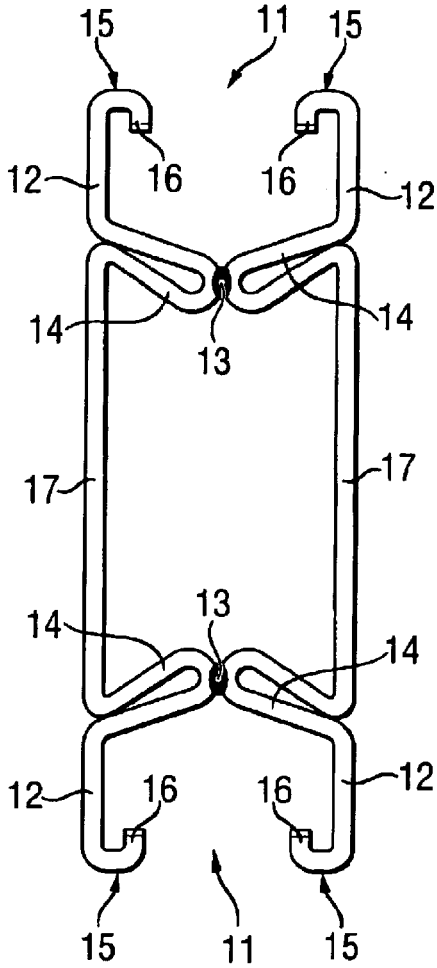

The rail profiles represented in FIGS. 2 to 5 are manufactured, for example, from two curved molded pieces that are materially bonded together along two vertical lines 13 by a weld seam. In contrast with the exemplary embodiment represented in FIG. 1, the two shaped parts are bent differently. Increased stability in certain target areas is provided by overlapping sections in those target areas, which is shown in particular in FIG. 2. A further possibility affecting stability is accomplished by forming a molded part in the target area, as shown in FIG. 4. Increased stability is guaranteed by the formation of essentially V-shaped and U-shaped cross-sections in the target areas. Since the stressing of the rail profile occurs especially transverse to the longitudinal axis of the rail profile, the cross-section of the rail profile exhibits such a characteristic cross-section in the plane normal to the longitudinal.

What is claimed is:

1. A rail profile formed by two curved shaped parts, with two connection zones (1) situated opposite and spaced to each other and having an essentially C-shaped cross-section, each of the connection zones (1) having two side walls (2) running approximately parallel to each other, whereby each side wall (2) extending from a rear wall (4) and free end zones (5) with a curvature with webs (6) running essentially parallel to the side walls (2), wherein the two rear walls (4) of each connection zone (1) are joined to each other by connection walls (7) each running essentially parallel to the side walls (2) and wherein the rear wall (4) exhibits an essentially V-shaped cross-section with a base angle (β) corresponding to the free end (5) that is smaller than 180°, wherein two curved shaped parts are bonded together along two vertical lines (3) of the rear wall (4) formed by the base angle (β) and wherein the two curved parts are bonded materially with each other, wherein the connection walls (7) are spaced to each other forming a box-like middle part of the rail profile (1).

2. The rail profile of claim 1, wherein the base angle (β) is approximately between 120° to 160°.

3. The rail profile of claim 1, wherein one of the vertical lines (3) of the rear wall formed by the base angle (β) runs approximately central to the side walls (2).

4. The rail profile of claim 3, wherein the vertical line (3) runs parallel to the side wall.

5. The rail profile of claim 4, wherein the plane running through the respective vertical line (3) forms a plane of symmetry of the rail profile.

6. The rail profile of claim 1, wherein a structural height (a) extending from one free end (5) to the corresponding free end (5) of the rail profile corresponds to 3.5 to 4.5 times a connection height (b) extending from one free end (5) to the corresponding rear wall (4).

7. The rail profile of claim 1, wherein the side walls (2) and the connection wall (7) of a curved shaped part are in the plane of the side walls (2).

* * * * *